United States Patent [19]

Rich

[11] Patent Number: 4,898,019

[45] Date of Patent: Feb. 6, 1990

[54] VEHICLE SUPPORT ASSEMBLY

[76] Inventor: John W. Rich, P.O. Box 810, Elburn, Ill. 60119

[21] Appl. No.: 299,548

[22] Filed: Jan. 18, 1989

[51] Int. Cl.[4] ..... B21D 1/12

[52] U.S. Cl. ..... 72/461; 72/705; 248/352

[58] Field of Search ..... 72/461, 705; 248/352, 248/503; 52/DIG. 11, 23

[56] References Cited

U.S. PATENT DOCUMENTS

| | | | |
|---|---|---|---|
| 4,138,876 | 2/1979 | Chisum | 72/705 |
| 4,221,122 | 9/1980 | Couturier | 72/705 |
| 4,337,636 | 7/1982 | Clausen | 72/705 |
| 4,628,723 | 12/1986 | Buske | 72/705 |
| 4,655,072 | 4/1987 | Miyoshi | 72/705 |

OTHER PUBLICATIONS

European Patent Application No. 0258933, pub. Mar. 9, 1989 Inventor: Eltvik, Björn.

European Patent Application No. 0297632, Pub. Jan. 4, 1989, Inventor: Bergström.

*Primary Examiner*—Lowell A. Larson

*Attorney, Agent, or Firm*—Robert E. Knechtel; Basil E. Demeur

[57] ABSTRACT

A vehicle support assembly for maintaining a vehicle in a stationary position during body straightening operations. A housing supports a horizontally extending arm and a shaft extends through and is supported by the housing. A clamping assembly within the housing includes a clamp with plural spaced-apart hooks which are located beneath a T-shaped tie down track. A lever is supported at one end of the shaft. A C-shaped cam is coupled to the clamp and the lever so that when the lever is operated the C-shaped cam raises the clamp and the spaced-apart hooks are clamped beneath the track thereby securing the vehicle support assembly to the track.

8 Claims, 1 Drawing Sheet

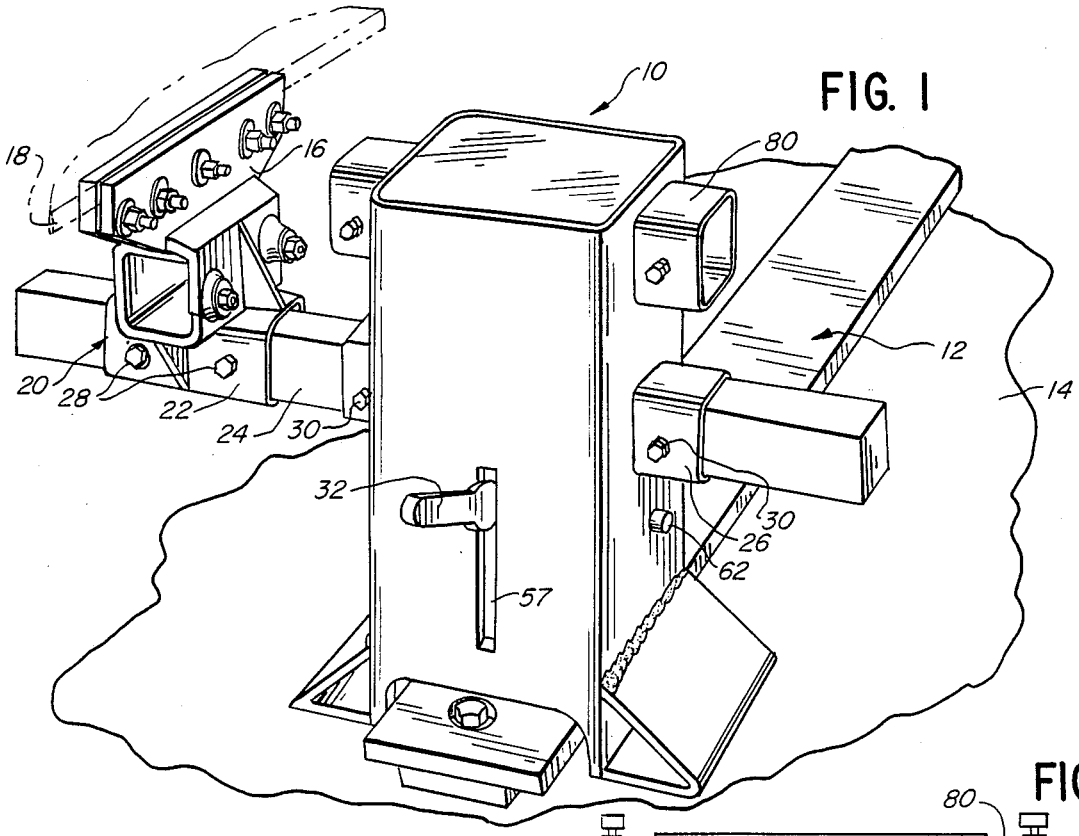
FIG. 1
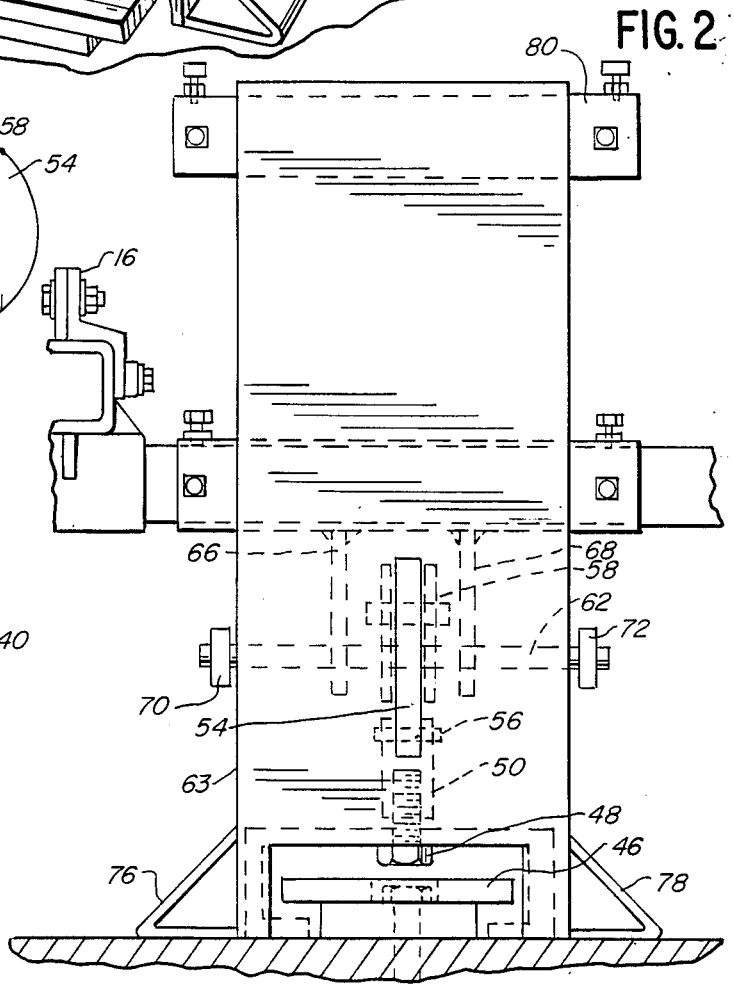
FIG. 2
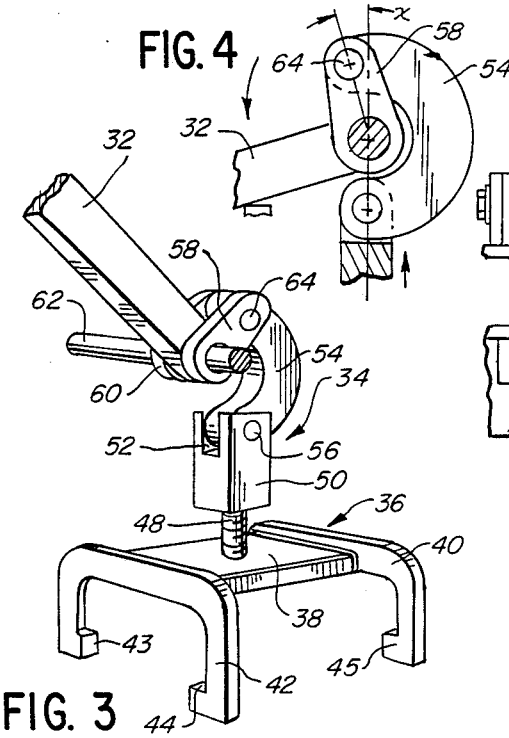
FIG. 3
FIG. 4

VEHICLE SUPPORT ASSEMBLY

This invention relates to a vehicle support assembly for maintaining a vehicle in a stationary position during body straightening operations. More particularly, the invention relates to a vehicle support assembly of the described type which can be easily and quickly adjustably positioned and lockingly secured in place.

Generally, tie down tracks are anchored to a support surface such as the floor, and the vehicle support assemblies are movable along these tie down tracks to adjustably position them for length adjustment depending upon the length of the vehicle. Once positioned, these vehicle support assemblies must be clamped to the tie down tracks to prevent them from moving during the body straightening operation.

In most cases, the vehicle support assemblies have clamping means which are caused to clampingly engage the tie down tracks by threadingly manipulating one or more threaded bolts. These threaded bolts are difficult and time consuming to manipulate to clamp and unclamp the vehicle support assembly to the tie down track. Accordingly, it would be desirable to have a vehicle support assembly which can be easily and quickly lockingly secured in place.

In accordance with the present invention, a vehicle support assembly is provided which can be easily and quickly adjustably positioned on a tie down track and then lockingly secured in place simply by pivotally operating a lever arm. The vehicle support assembly likewise is unclamped from the tie down track so that it can be moved by again pivotally operating the lever arm.

Accordingly, it is an object of the present invention to provide an improved vehicle support assembly which can be easily and quickly adjustably positioned and which can be easily and quickly clamped to and unclamped from a tie down track.

The above objects as well as other objects and features of the invention will become apparent from the following description when taken in conjunction with the drawing, in which FIG. 1 is a perspective view of a vehicle support assembly exemplary of the invention positioned on a tie down track;

FIG. 2 is a side plan view of the vehicle support assembly;

FIG. 3 is a perspective view of the clamping assembly of the vehicle support assembly; and FIG. 4 is a partial side plan view of the clamping assembly showing the over-the-center locking arrangement thereof.

DESCRIPTION OF A PREFERRED EMBODIMENT

Referring now to the drawing, in FIG. 1 there is shown a vehicle support assembly 10 exemplary of the invention affixed to a tie down track 12 which is secured to a support surface such as the floor 14. Normally, with a body straightening system, there are at least a pair of such tie down tracks 12 secured in spaced-apart relationship such that a vehicle can be positioned between them and anchored in a stationary position. The vehicle is anchored by means of pinch-weld clamps 16 which are clamped to the lower pinch weld 18 found on all unitized vehicles. The pinch-weld clamps 16 are part of an assembly 20 which includes a hollow tube member 22. The hollow tube member 22 is slidably disposed on a shaft 24 which is horizontally disposed and adapted to be received in and through a hollow tube 26 extending through the vehicle support assembly 10. The tube member 22 and the shaft 24 permits the pinch-weld clamp 16 to be adjustably positioned to compensate for the width of a vehicle and/or the location of the vehicle between the two tie down tracks 12. The support assembly 10 is positionable along the length of the tie down track 12 to position the pinch-weld clamp 16 as required depending upon the length of the vehicle. Once the pinch-weld clamp 16 is clamped to the pinch-weld 18 of the vehicle, the assembly 20 is clamped in position on the shaft 24 by means of the threaded bolts 28, and the shaft 24 is clamped in position in the vehicle support assembly 10 by means of the threaded bolts 30.

As indicated above, the vehicle support assembly 10 is positioned along the length of the tie down track 12 to position the pinch-weld clamp 16 as required depending upon the length of the vehicle to which the pinch-weld clamps 16 are clamped. The vehicle support assembly 10 then is securely clamped to the tie down track 12 to prevent it from moving, particulary if a pull force is applied to the vehicle parallel or substantially parallel to the axis of the tie-down tracks 12. This is easily and quickly accomplished with the vehicle support assembly 10 of the invention, simply by pivotally operating the lever arm 32 to clamp the vehicle support assembly 10 to the tie down track 12.

More particularly, as can be best seen in FIGS. 2 and 3, the vehicle support assembly 10 is of a hollow tubular construction and has disposed therein a tie-down track clamp assembly 34 (FIG. 3) which includes a clamp member 36 comprised of a plate 38 that is generally rectangular shaped and has fixedly secured to it in spaced-apart relationship a pair of clamp arms 40 and 42 that are generally U-shaped and have hooks such as the hooks 43–45 on the ends thereof. These clamp arms 40 and 42, as can be best seen in FIG. 2, are proportioned such that the hooks 43–45 can be disposed beneath the upper track member 46 of the T-shaped tie down tracks 12, and the vehicle support assembly 10 can be slidably positioned along the length of the tie-down track 12.

A threaded bolt 48 extends through the plate 38 of the clamp member 36 and is threadedly received within a connecting block 50. The connecting block 50 has a slot 52 in it in which there is disposed one end of a C-shaped cam 54. The end of the C-shaped cam 54 is rotatably secured therein by means of a pin 56. The opposite end of the C-shaped cam 54 is rotatably secured by means of a pin 64 between a pair of spaced-apart lever arms 58 and 60 which are secured to the opposite sides of one end of the lever 32 which, when the tie down clamp assembly 34 is affixed within the vehicle support assembly 10, extends out of the latter through a slot 57.

The tie down clamp assembly 34 is affixed within the vehicle support assembly 10 by means of a shaft 62 which is extended through shaft receiving apertures in the side walls 63 and 65 of the vehicle support assembly 10 and in the lever arms 58, 60 and the lever 32. In addition, the shaft 62 extends through two spaced apart shaft support brackets 66 and 68 fixedly secured to the hollow tube 26 within the vehicle support assembly 10. A pair of retaining collars 70 and 72 secure the shaft 62 within the vehicle support assembly 10.

Affixed to the two side walls 63 and 65 of the vehicle support assembly 10 are two triangular-shaped gussets 76 and 78. These gussets 76 and 78 provide additional lateral support for the vehicle support assembly 10. Also, an additional shaft 80 can be provided through the vehicle support assembly 10 for receiving therethrough the shaft 24 so that the assembly 20 can be raised, if desired.

Initially, the vehicle support assembly 10 is slidably disposed on the tie down track 12, with the hooks 43–45 disposed beneath the upper track member 46 of the T-shaped tie down track. The threaded bolt 48 then is threadedly adjusted so that when the lever arm 32 is pivotally operated downwardly until it hits the bottom of the slot 57 the lever arms 58, 60 and the C-shaped cam 54 are rotated to an over-the center locking position, at which point the hooks 43–45 are tightly clamped against the underside of the upper track member 46 to securely clamp the vehicle support member 10 to the tie down track 12. Once adjusted, the vehicle support member 10 can be positionally adjusted on the tie down track 12 and securely clamped to it simply by pivotally manipulating the lever 32.

From the above description of the construction and operation of the vehicle support assembly, it can be seen that the vehicle support assembly can be easily and quickly positioned and lockingly clamped against movement simply by operating a lever. Likewise, the vehicle support assembly can be released to reposition it simply by again operating the lever to disengage the clamping assembly. Accordingly, the vehicle support assembly provides a vast improvement over presently existing vehicle support assemblies.

What is claimed is:

1. In combination with a system for body and frame straightening having at least a pair of tie down tracks which are fixedly secured in spaced apart relationship to a supporting surface, said tie down tracks each being generally T-shaped in cross-section with an upper track member and a lower track member, at least one vehicle support assembly, and a horizontally extending arm having on one end thereof a clamping device for clamping the bottom body flange of a vehicle body to maintain said vehicle body in a stationary position during body straightening operations, the improvement comprising an improved vehicle support assembly comprising a housing supporting said horizontally extending arm, a shaft extending through and supported by said housing, a clamping assembly disposed within said housing comprising a clamp member having a plurality of spaced-apart hooks which are disposed beneath the upper track member of said T-shaped tie down track, a lever pivotally supported at one end thereof by said shaft, a C-shaped cam coupled at one end thereof to said clamp member and coupled at the other end thereof to said one end of said lever, said lever upon being pivotally operated operating said C-shaped cam to raise said clamp member to thereby clamp said spaced-apart hooks beneath said upper track member of said T-shaped tie down track to clampingly secure said vehicle support assembly to said tie down track.

2. The improved vehicle support assembly of claim 1, wherein said C-shaped cam is coupled at one end thereof to said clamp member by means of a threaded bolt extending through said clamp member, a cam connecting block affixed to said one end of said C-shaped cam, said threaded bolt being threadedly received in said cam connecting block, said threaded bolt being threadedly manipulated to adjustably position said clamp member to clampingly engage said spaced-apart hooks beneath said upper track member of said T-shaped tie down track when said lever is pivotally operated to a stop position.

3. The improved vehicle support assembly of claim 2, wherein said C-shaped cam is operated to an over-the-center lock position to lock said lever in said stop position when said lever is pivotally operated to said stop position.

4. The improved vehicle support assembly of claim 1, further comprising at least one lever arm secured to said one end of said lever, said C-shaped cam being coupled at said other end thereof to said lever arm, said lever upon being pivotally operated operating said lever arm to raise said C-shaped cam to raise said clamp member to thereby clamp said spaced-apart hooks beneath said upper track member of said T-shaped tie down track to clampingly secure said vehicle support assembly to said tie down track.

5. The improved vehicle support assembly of claim 4, wherein said C-shaped cam is coupled at one end thereof to said clamp member by means of a threaded bolt extending through said clamp member, a cam connecting block affixed to said one end of said C-shaped cam, said threaded bolt being threadedly received in said cam connecting block, said threaded bolt being threadedly manipulated to adjustably position said clamp member to clampingly engage said spaced-apart hooks beneath said upper track member of said T-shaped tie down track when said lever is pivotally operated to a stop position.

6. The improved vehicle support assembly of claim 5, wherein said C-shaped cam is operated to an over-the-center lock position to lock said lever in said stop position when said lever is pivotally operated to said stop position.

7. The improved vehicle support assembly of claim 6, further comprising a hollow tube extending through said housing for receiving therethrough and supporting said horizontally extending arm, and means for securing said horizontally extending arm in said hollow tube.

8. The improved vehicle support assembly of claim 7, further comprising support means affixed to two opposite sides of said housing for adding lateral support to said housing.

* * * * *